US005941253A

United States Patent [19]

Kaizuka

[11] Patent Number: 5,941,253

[45] Date of Patent: Aug. 24, 1999

[54] ELECTRIC IRON FOR HAIRDRESSING

[75] Inventor: Kazutoshi Kaizuka, Fukuoka, Japan

[73] Assignee: Create Co., Ltd., Japan

[21] Appl. No.: 09/150,827

[22] Filed: Sep. 10, 1998

[51] Int. Cl.[6] ..... A45D 1/04

[52] U.S. Cl. ..... 132/232; 219/223

[58] Field of Search ..... 132/224, 225, 132/223, 232, 234; 219/223, 225

[56] References Cited

U.S. PATENT DOCUMENTS

| | | | |
|---|---|---|---|
| 4,151,850 | 5/1979 | Nathe et al. | 132/225 |
| 4,477,716 | 10/1984 | Thaler et al. | 132/232 |
| 4,549,560 | 10/1985 | Andis | 132/232 |
| 4,567,904 | 2/1986 | Pitcher et al. | 132/232 |
| 4,740,669 | 4/1988 | Takimae | 132/232 |

*Primary Examiner*—Todd E. Manahan
*Attorney, Agent, or Firm*—Graham & James LLP

[57] ABSTRACT

An electric iron for hairdressing makes it possible to realize a firm curl in a short period of time, thus preventing damage to hair thanks to the action of negative ions generated from the surface of the rod and glove. The electric iron for hairdressing (A) is comprised of a heated (7) rod (2) and a glove (4) which are joined by a pivot to enable free opening and closing is characterized by said rod and glove being surface treated with fluoroplastic to form a coating layer (6). At least one of the said coatings (6) of the rod (2) or glove (4) is formed by mixing the fluoroplastic with poly-element minerals in powder form, obtained by milling poly-element minerals.

1 Claim, 1 Drawing Sheet

ELECTRIC IRON FOR HAIRDRESSING

BACKGROUND OF THE INVENTION

1. Field of the Invention

The field of the invention relates to electric irons for hairdressing which are used to curl hair (for example, for a kinky permanent).

2. Background Information

Known conventional electric irons for hairdressing are comprised of a heater incorporated with a rod, and a glove, which are joined by a pivot so they may open and close freely. In addition, said rod and glove are surface treated with fluoroplastic in order to be heat resistant, chemical resistant and non-stick. There are various types of rods for conventional electric irons for hairdressing, such as those comprised of some projections on the outer face of rod for pinching hair. Some cross sections of rods are triangular, rectangular and polygonal instead of being round. Further, there are various types of gloves, such as those with small or large widths, and those of different shapes.

However, the rod and glove of the conventional electric irons for hairdressing are coated with fluoroplastic so that they may be heat resistant, chemical resistant and non-stick. This setting leads to a problem of hair damaged by the heat when it is treated with said rod and glove for curling.

Thus, the object of the present invention is to provide an electric iron for hairdressing which makes it possible to attain satisfactory curling in a short time while preventing damage to hair, thanks to the action of negative ions generated from the surfaces of the rod and glove.

SUMMARY OF THE INVENTION

In order to overcome the above-mentioned problem, the present invention of an electric iron for hairdressing, comprised of a heated rod and a glove which are joined by a pivot enabling free opening and closing actions, is constructed in such a way that said rod and glove are surface treated with fluoroplastic to form a coating layer and at least one of said fluoroplastic coatings of the rod or glove is a mixture of fluoroplastic and poly-element minerals in powder form, which is obtained by milling poly-element minerals.

The preferred embodiment is characterized by the fact that the coating layer of either the rod or the glove or both is mixed with poly-element minerals in powder form which is obtained by milling poly-element minerals. This will cause negative ions to be generated from the surface at all times while treatment. Thus, when curling hair by pinching it with the rod and glove, water is sufficiently impregnated into the hair due to the cluster phenomenon, an action of negative ions that reduces the size of the aggregation of water molecules which activates the protein in hair, thus creating a firm curl in a short time. In addition, damage to hair can be made minimal.

BRIEF DESCRIPTION OF THE DRAWINGS

With reference to the accompanying figures, embodiment of the present invention will be explained more in detail.

DETAILED DESCRIPTION OF THE PREFERRED EMBODIMENT

Figure 1:
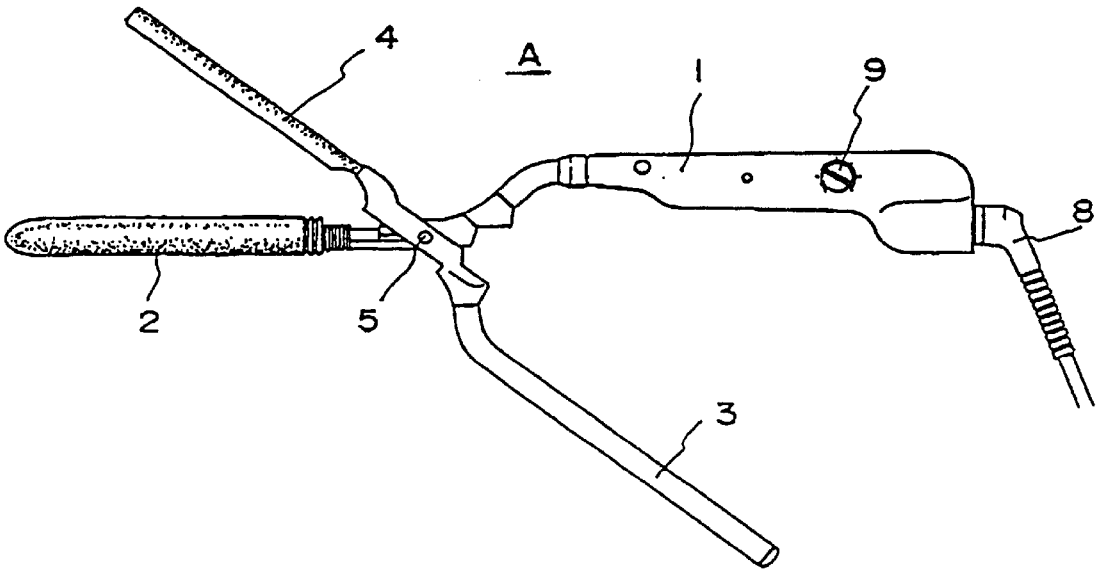
FIG. 1 is a side view of an electric iron for hairdressing, showing an example of the preferred embodiment of the invention.
Figure 2:
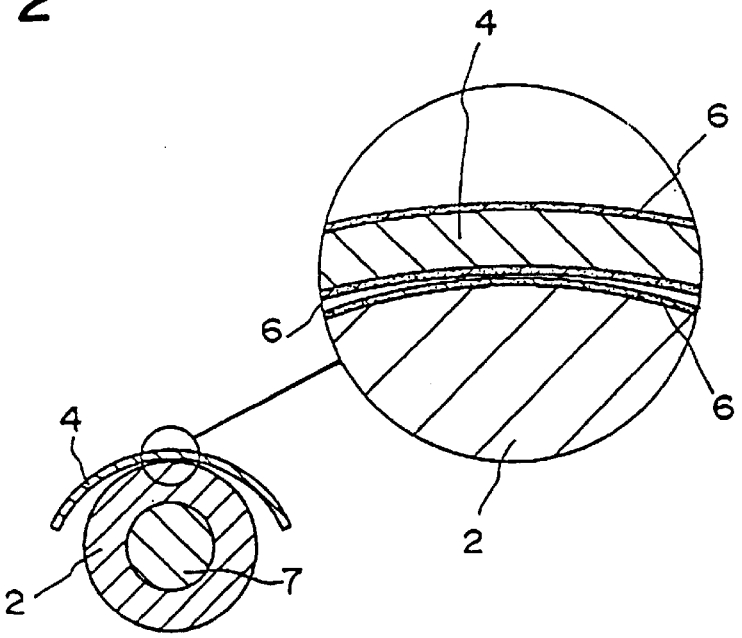
FIG. 2 is a sectional view of the rod of the iron shown in FIG. 1.

The preferred embodiment (A), is comprised of a rod (2) attached to the end of a handle (1) and a glove (4) attached to the end of a handle (3), which are joined by a pivot (5) in such a way that said rod (2) and glove (4) can be opened and closed on the pivot (5) like scissors. Said rod (2) and glove (4) are coated on the surface with fluoroplastic mixed with poly-element minerals in powder form which is obtained by milling poly-element minerals, and then baked so as to form a coating layer (6). In these figures, (7) represents a heater, (8) represents a cord connected to said heater, and (9) represents a switch for temperature adjustment.

The term, "poly-element mineral" used here designates a mineral containing silicon as a main component and many other elements with a good balance, such as tourmaline, pearlite, and pitchstone. A poly-element mineral, such as pearlite, is milled into a powder the size of about 1 to 3 microns, using a ball mill. It is preferable to formulate more than two poly-element minerals into powder. The pearlite is composed of the following components.

TABLE 1

| | | |
|---|---|---|
| Anhydrous Silicon | ($SiO_2$) | 71.94% |
| Aluminum Oxide | ($Al_2O_3$) | 14.94% |
| Iron Oxide | ($Fe_2O_3$) | 2.54% |
| Magnesium Oxide | (MgO) | 0.44% |
| Calcium Oxide | (CaO) | 2.47% |
| Alkali Oxide | ($K_2O + Na_2O$) | 6.87% |
| Manganese Oxide | (MnO) | 0.03% |
| Anhydrous Phosphoric Acid | ($P_2O_5$) | 0.14% |
| Reduction in mass when heated | | 3.43% |
| Reduction in mass when dried | (at 110° C.) | 0.07% |
| Others, titanium | | trace |

The poly-element minerals in powder form may be mixed in a coating of fluoroplastic as it is. Further, after mixing it with water and heating or applying pressure, it is also possible to include in the coating of fluoroplastic the supernatant as it is, or the powder obtained by vacuum freeze-drying or spray drying said supernatant.

Thus, for treating hair with the electric iron (A), the rod (4) and the glove (2) are rotated while the hair is pinched, in a manner similar to the prior procedure, so as to curl the hair.

In the case of treating hair with the present preferred embodiment (A), its coated layer (6) that includes the poly-element minerals in powder form generates negative ions all the time, causing the action, cluster phenomenon which impregnates water sufficiently into the hair. Therefore, the hair will not be damaged being pinched with the rod (2) and the glove (4), and can be curled in a short time.

During said process, an initial agent, such as ammonium thioglycolate, is applied to the hair so as to swell it and at the same time to cut the sulfur bond between hair protein molecules. Hair is curled using the electric iron for hairdressing as mentioned above, with the hair protein molecules being transferred in accordance with the condition of curling. Then, a second agent, such as sodium bromate is applied to the hair so as to regenerate the sulfur bond between hair protein molecules and, thus, fixing the curled hair as it is.

An example of embodiment of the present invention has been explained above. However, specific constructions of the present invention are not limited to the example given above. The present invention shall include any variation or modification in design as necessary.

For example, although poly-element minerals in powder form are included in both coating layers of the rod and glove with the above example, they may be included in only one of the coating layers.

Further, the cross sections of said rod can be in a variety of shapes, such as those with some projections on the outer surface for pinching hair. Cross sections of the rods can be triangular, rectangular or polygonal instead of being round. The glove can also be in any shape, such as those with small or large widths.

Furthermore, the shape of the electric iron for hairdressing is not limited to that of sewing shears with a pivot in the middle, but may be like that of grip scissors with a pivot at the end.

I claim:

1. An electric iron for hairdressing comprising:

a heated rod, having a first coated layer treated with a fluoroplastic; and a glove, pivotally connected to said rod, and having a second coated layer treated with a fluoroplastic;

wherein at least one of said coated layers contains fluoroplastic mixed with poly-element minerals in powder form.

* * * * *